United States Patent [19]

Quesada et al.

[11] Patent Number: 5,059,100

[45] Date of Patent: Oct. 22, 1991

[54] DISCHARGE LINE RESTRAINT

[75] Inventors: John F. Quesada, Clay; Douglas A. Schrank, Baldwinsville; David K. Haller, North Syracuse; Lin Su, Liverpool; Charles R. Spagnoli, Syracuse; James S. Laub, Fayetteville, all of N.Y.

[73] Assignee: Carrier Corporation, Syracuse, N.Y.

[21] Appl. No.: 552,661

[22] Filed: Jul. 16, 1990

[51] Int. Cl.[5] ..... F04B 39/00

[52] U.S. Cl. ..... 417/312; 417/363; 417/902

[58] Field of Search ..... 417/312, 363, 902

[56] References Cited

U.S. PATENT DOCUMENTS

| | | | |
|---|---|---|---|
| 3,082,939 | 3/1963 | Warner | 417/363 |
| 3,246,836 | 4/1966 | Ayling | 417/902 |
| 3,857,652 | 12/1974 | Thayer | 417/312 |
| 4,033,707 | 7/1977 | Stutzman | 417/312 |

FOREIGN PATENT DOCUMENTS

| | | | |
|---|---|---|---|
| 32981 | 8/1981 | Japan | 417/312 |
| 32982 | 8/1981 | Japan . | |

*Primary Examiner*—Leonard E. Smith

[57] ABSTRACT

In a hermetic reciprocating compressor, the discharge line functions as a torsion spring in supporting the compressor and motor within the hermetic shell. To prevent excessive deflection of the discharge line while maintaining its torsion spring function, the discharge line is restrained radially and axially while permitting circumferential movement in a helical portion which defines the torsion spring.

6 Claims, 3 Drawing Sheets

DISCHARGE LINE RESTRAINT

BACKGROUND OF THE INVENTION

The shell of a hermetic compressor used for refrigeration and air conditioning applications contains refrigerant. When the refrigerant in the shell is at suction pressure it is a low side unit. If the shell contains refrigerant at discharge pressure, it is a high side unit. The compressor within the shell is normally resiliently supported to accommodate the shocks at start-up and shutdown as well as to provide some sound isolation between the compressor and its shell. In the case of a low side unit, the compressor discharge serially passes through a muffler and the discharge line before leaving the shell. Typically, the discharge line defines a helix like structure which extends over approximately a 300° arc and which functions as a torsion spring to assist in resiliently supporting the compressor within the shell. Since the torsion spring function is desirable, the discharge line is normally unrestrained over most, or all, of its length.

SUMMARY OF THE INVENTION

Under flooded start or liquid slugging conditions liquid refrigerant and/or oil pass through a reciprocating compressor at high pressure and velocity with little or no reduction in volume and, in doing so, cause the discharge line to undergo extreme deflections. By restraining the discharge line, the deflections are controlled, stresses are lowered, and liquid slugging life is greatly increased. However, the restraint device must also allow free circumferential motion of the discharge line to accomplish the discharge line's function as a torsional spring for the internal assembly of the compressor. The material in contact with the discharge line must withstand temperatures in excess of 300° F., retain toughness upon impact, and maintain good wear characteristics while being exposed to refrigerant and/or lubricant.

It is an object of this invention to reduce stress in the discharge line of a compressor due to liquid slugging while permitting the line to function as a torsional spring.

It is another object of this invention to restrain discharge line displacement in two directions while permitting sliding due to torsion.

It is a further object of this invention to increase compressor reliability. These objects, and others as well become apparent hereinafter, are accomplished by the present invention.

Basically, the internal discharge line of a hermetic, reciprocating compressor is restrained axially and radially but is permitted to move circumferentially. Thus the discharge line functions as a torsion spring.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
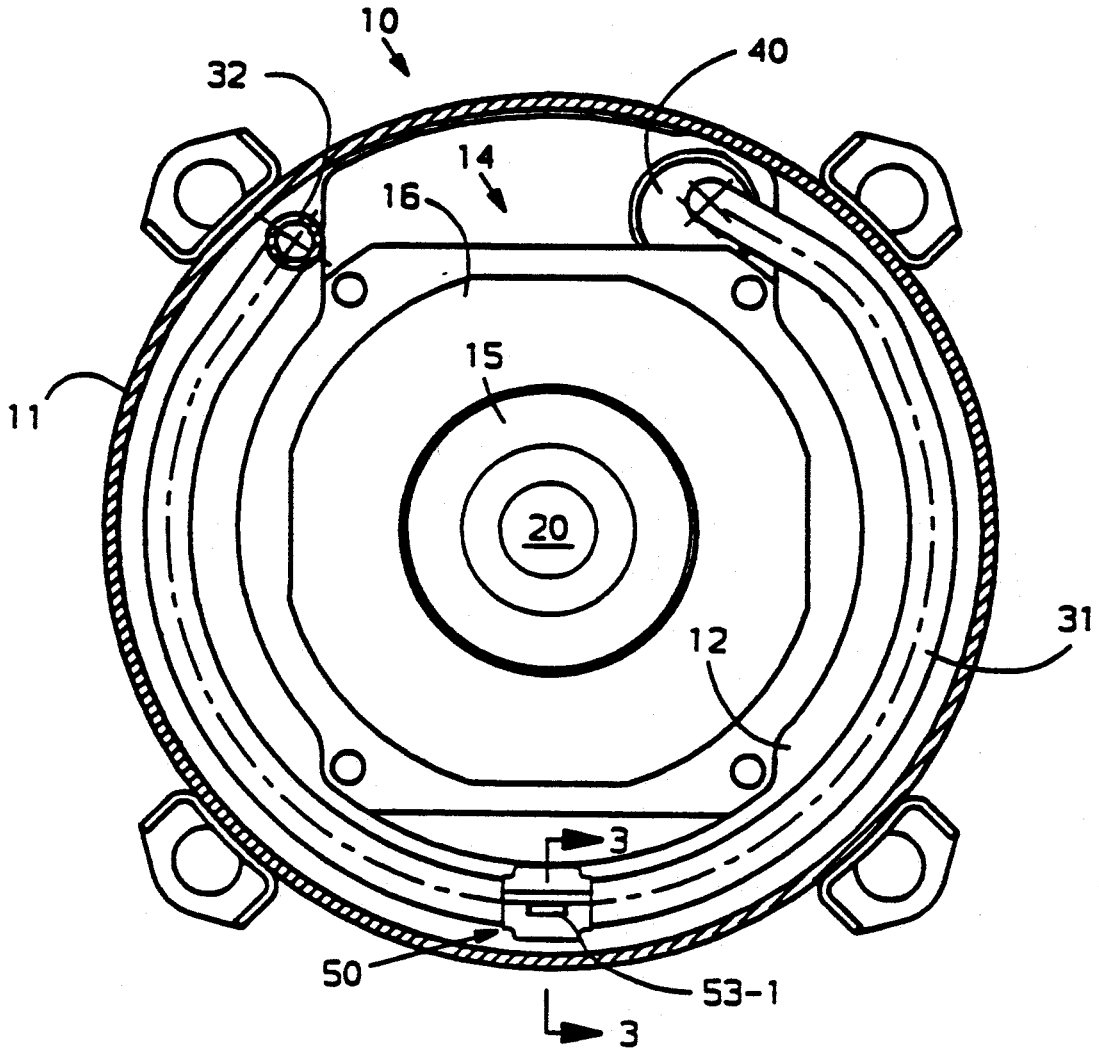
FIG. 1 is a top view of a hermetic compressor employing the present invention and with a portion of the shell cutaway.
Figure 2:
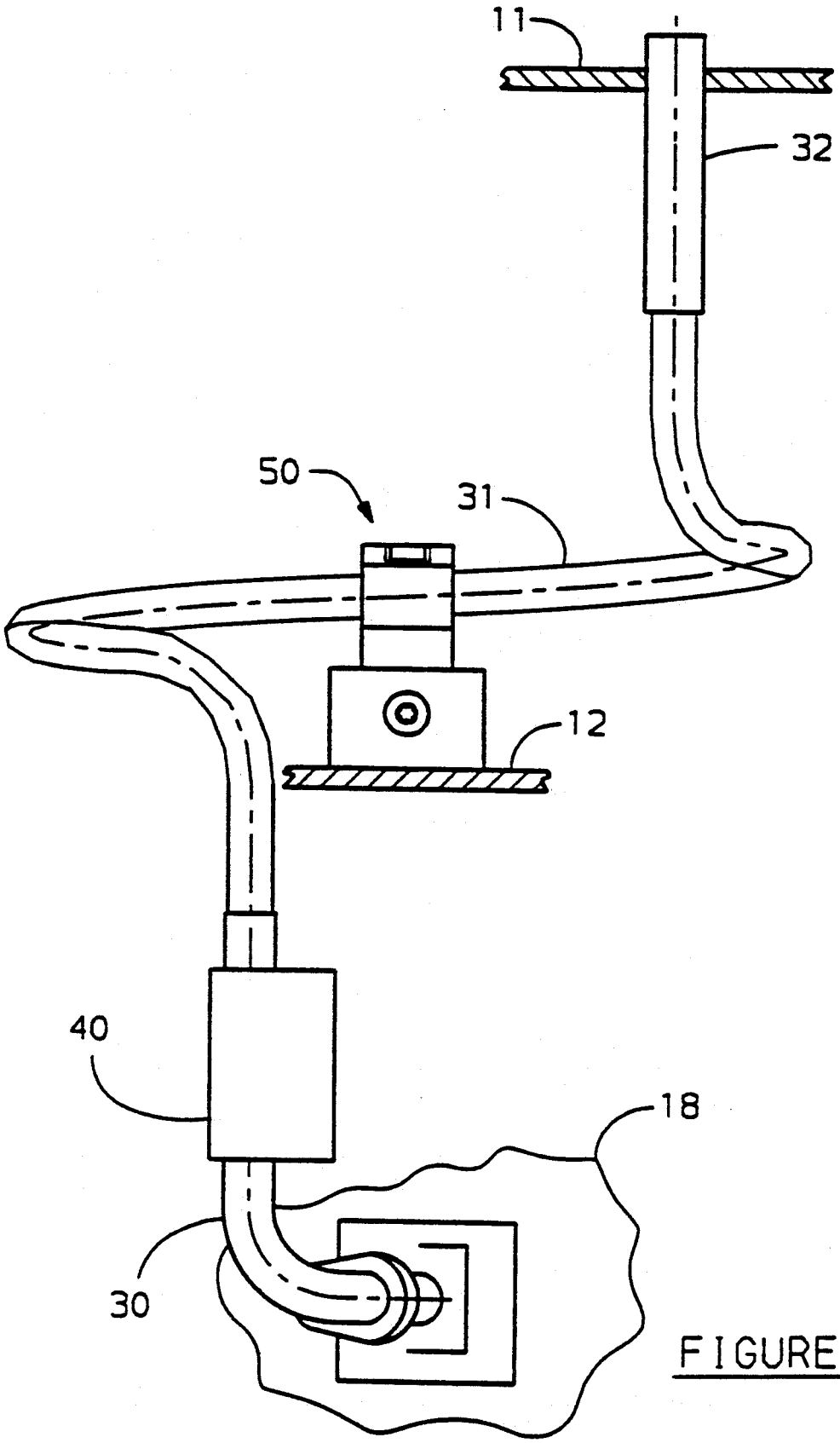
FIG. 2 is a pictorial view of the discharge line and a portion of the hermetic compressor of FIG. 1.

In FIG. 1, the numeral 10 generally designates a low side hermetic reciprocating compressor. Compressor 10 includes a shell 11 containing a motor 14 having a rotor 15 and a stator 16. Crankshaft 20 is shrunk fit or otherwise suitably secured to rotor 15 so as to be rotatable therewith. Referring now to FIGS. 1 and 2, compressed gas passes from the cylinders (not illustrated) in crankcase 18 into the elbow 30 and then into discharge line 31 via muffler 40. As is best shown in FIG. 1, the discharge line 31 extends in a helix for about 300° downstream of muffler 40 and exits the shell 11 via vertical leg 32.

Figure 3:
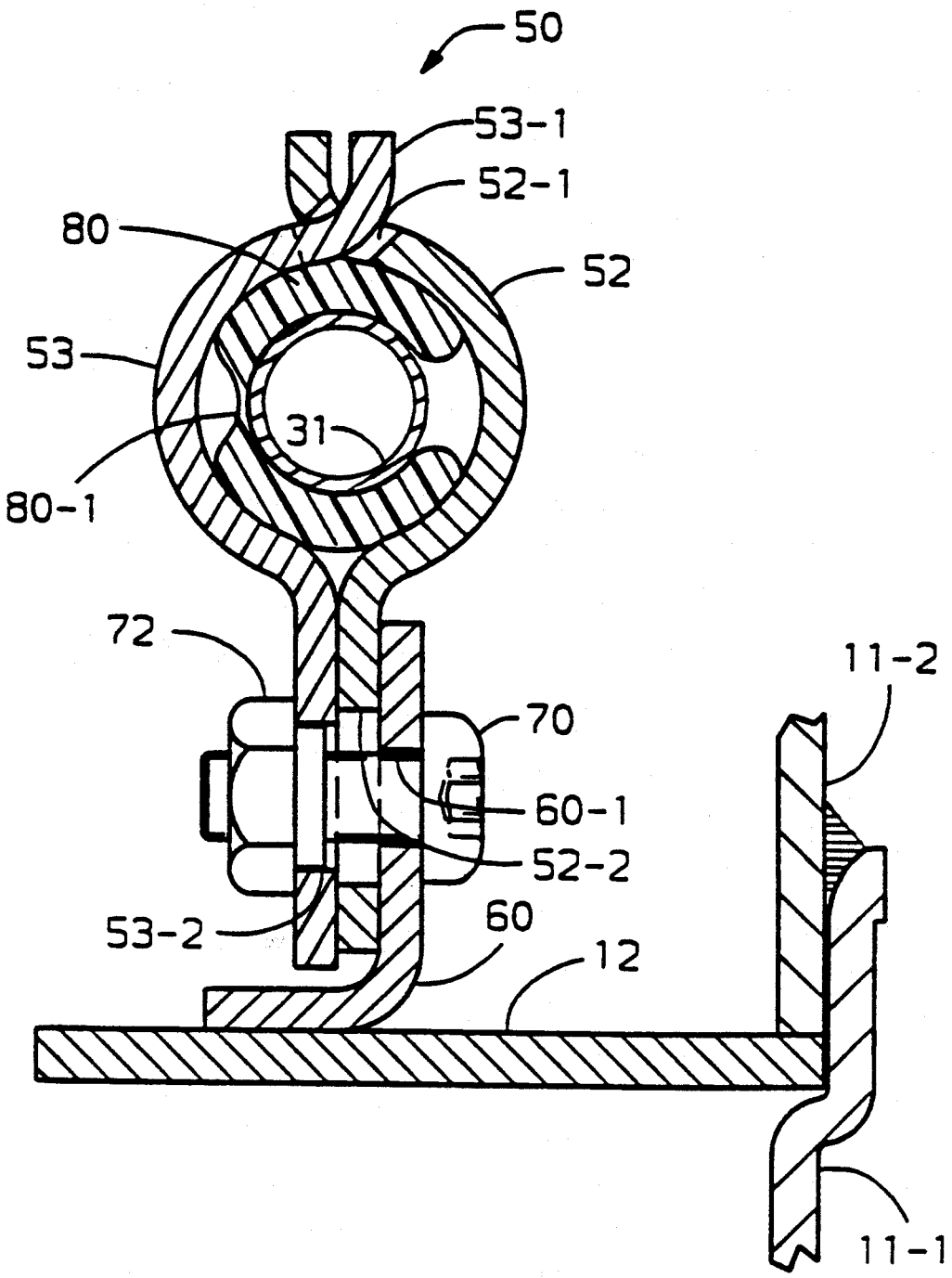
FIG. 3 is a sectional view taken along line 3–3 of FIG. 1.

The discharge line 31 is secured at the anti-node (point of highest displacement) of the helix for its first vibratory mode by clamp assembly 50. Referring specifically to FIG. 3, clamp assembly 50 includes a first C-shaped clamp member 52 having a hole 52-1 formed therein and a second C-shaped clamp member 53 having a tang 53-1 adapted to be received in hole 52-1 so as to define therewith a hinge. Bracket 60 is welded to mounting ring 12 which is, in turn, welded to the inner surface of shell 11 at the joint between lower shell 11-1 and upper shell 11-2. Bracket 60 has a bolt hole 60-1 formed therein. Similarly, first and second clamp members 52 and 53 have bolt holes 52-2 and 53-2, respectively. Bolt 70 is adapted to be received in bolt holes 60-1, 52-2 and 53-2 and to coact with nut 72 to hold clamp assembly 50 closed and secured to mounting ring 12. Bushing 80 is preferably made of heat stabilized polyamide (nylon) having excellent toughness and impact resistance such as Zytel ST-801 HS which is available from E.I. Du Pont De Nemours & Co. Bushing 80 receives discharge line 31 and is, in turn, held between clamp members 52 and 53. Bushing 80 is of a C-shape in cross section and includes a thin wall section 80-1 which acts as a hinge portion. With discharge line 31 held as illustrated in FIG. 3, it is unable to move in the plane of the paper. However, discharge line 31 is able to slide in bushing 80 in a direction into and out of the paper in the FIG. 3 position or right to left and vice versa in the FIG. 1 position.

Discharge line 31, as noted above, serves as a torsion spring in supporting the motor and compressor within shell 11. To achieve the necessary torsional flexibility, the discharge line 31 is, typically, made of thin wall tubing about 0.032 inches thick. When compressor 10 is operating under liquid refrigerant abuse conditions, discharge tube 31 carries high pressure fluid at velocities in excess of 200 miles per hour and at a temperature in excess of 300° F. As a result discharge tube 31 is subject to extreme deflections and, consequently severe plastic deformation and ultimate failure. These actions take place within the shell 11 and were not understood and, in addition, the torsional spring function of the discharge line 31 is desired.

It has been found that by restraining the discharge line 31 in the axial and radial directions of the helix while permitting circumferential movement, deflections are controlled, stresses lowered, the liquid slugging life is increased and the discharge line 31 still functions as a torsion spring. Bushing 80 is in sliding contact with the discharge tube 31 which reaches temperatures in excess of 300° F. during operation while being in an environment of refrigerant and lubricant. So in addition to withstanding elevated temperatures, bushing 80 must provide a low friction and wear resistant support to discharge line 31. This permits discharge line 31 to circumferentially slide through bushing 80 which functions as a linear bearing during start-up and shutdown in performing its torsional spring function.

Although a preferred embodiment of the present invention has been illustrated and described, other modifications will occur to those skilled in the art. For example, although a reciprocating hermetic compressor is described, the invention is applicable to all low side positive displacement hermetic compressors. It is therefore intended that the present invention is to be limited only by the scope of the appended claims.

What is claimed is:

1. In a hermetic compressor means including a motor and compressor within a hermetic shell and a discharge means extending from said compressor through said shell and having a helical portion defining a torsional spring for supporting said motor compressor within said shell, the improvement comprising:

clamping means secured to said shell and supporting said helical portion so as to restrict radial and axial movement of said helical portion while permitting circumferential movement of said helical portion.

2. The improvement of claim 1 wherein said clamping means includes a bushing which acts as a linear bearing with respect to said helical portion.

3. The improvement of claim 2 wherein said bushing is made of heat stabilized polyamide.

4. A hermetic compressor means comprising:

discharge means including a muffler and a discharge line having a helical portion extending from said compressor through said shell such that said helical portion functions as a torsion spring in supporting said motor and compressor within said shell;

clamping means coacting with said helical portion to restrict axial and radial movement of said helical portion while permitting circumferential movement of said helical portion whereby said helical portion acts as a torsion spring but is prevented from excessive vibratory movement.

5. The hermetic compressor of claim 4 wherein said clamping means includes a bushing which acts as a linear bearing with respect to said helical portion.

6. The hermetic compressor of claim 5 wherein said bushing is made of heat stabilized polyamide.

* * * * *